US009534357B2

(12) United States Patent
Haslett et al.

(10) Patent No.: US 9,534,357 B2
(45) Date of Patent: Jan. 3, 2017

(54) EXCAVATOR WEAR ASSEMBLY

(71) Applicant: CQMS Pty Ltd, Murarrie (AU)

(72) Inventors: David Haslett, Mackay (AU); Douglas Wallis, Mackay (AU); Benjamin Charles Plant, Goodna (AU); Luke Wilkie, Goodna (AU)

(73) Assignee: CQMS PTY LTD (AU)

( * ) Notice: Subject to any disclaimer, the term of this patent is extended or adjusted under 35 U.S.C. 154(b) by 0 days.

(21) Appl. No.: 14/760,361

(22) PCT Filed: Jan. 28, 2014

(86) PCT No.: PCT/AU2014/000049

§ 371 (c)(1),
(2) Date: Jul. 10, 2015

(87) PCT Pub. No.: WO2014/113845

PCT Pub. Date: Jul. 31, 2014

(65) Prior Publication Data

US 2016/0002893 A1 Jan. 7, 2016

(30) Foreign Application Priority Data

Jan. 25, 2013 (AU) ..... 2013900276

(51) Int. Cl.
*E02F 9/28* (2006.01)

(52) U.S. Cl.
CPC ..... *E02F 9/2883* (2013.01); *E02F 9/2825* (2013.01); *E02F 9/2833* (2013.01); *E02F 9/2858* (2013.01)

(58) Field of Classification Search
CPC ..... E02F 9/2816; E02F 9/2825; E02F 9/2858; E02F 9/2883; E02F 9/2841; E02F 9/2833
(Continued)

(56) References Cited

U.S. PATENT DOCUMENTS 805,004 A 11/1905 Cupples
1,485,434 A 3/1924 Seal
(Continued)

FOREIGN PATENT DOCUMENTS

GB 1272955 5/1972
WO WO 2008/119103 A1 10/2008

OTHER PUBLICATIONS

Australian Patent Office, International Search Report in International Patent Application No. PCT/AU2014/000049 (Mar. 7, 2014).
(Continued)

*Primary Examiner* — Robert Pezzuto
(74) *Attorney, Agent, or Firm* — Leydig, Voit & Mayer, Ltd.; John Augustyn

(57) ABSTRACT

An excavator wear assembly comprising a mounting nose having a rear bearing face, a forward bearing face, an upper bearing face disposed at an angle between the rear bearing face and the forward bearing face, a front face substantially perpendicular to the forward bearing face and a rib extending over at least part of the upper bearing face, forward bearing face and front face; and a wear member having a rearwardly opening socket adapted to receive the mounting nose, the socket being at least partially defined by a top wall and a front wall, the wear member having a recess formed in the top wall and front wall adapted to receive at least part of the rib.

25 Claims, 4 Drawing Sheets

(58) Field of Classification Search
USPC ..... 37/446, 452–460
See application file for complete search history.

(56) References Cited

U.S. PATENT DOCUMENTS

| | | | | | |
|---|---|---|---|---|---|
| 3,740,876 | A * | 6/1973 | Solokhin | E02F 9/2833 | 37/457 |
| 5,144,762 | A * | 9/1992 | Robinson | E02F 9/2816 | 37/453 |
| H2020 | H * | 5/2002 | Kesavan | | 37/455 |
| 2007/0051022 | A1 | 3/2007 | Meyers et al. | | |
| 2008/0028644 | A1 | 2/2008 | Lopez Almendros et al. | | |

OTHER PUBLICATIONS

Australian Patent Office, International Preliminary Report on Patentability in International Patent Application No. PCT/AU2014/000049 (Jun. 2, 2014).

* cited by examiner

EXCAVATOR WEAR ASSEMBLY

FIELD OF THE INVENTION

This invention is concerned with a wear member assembly for earth excavating devices. The invention is concerned particularly, although not exclusively, with the mounting of a wear member to a mounting nose of a lip for an earth excavating device.

BACKGROUND OF THE INVENTION

Excavator tooth assemblies mounted to the cutting lip of excavator buckets and the like generally comprise a replaceable digging tooth and an adaptor which is secured by welding or the like to the cutting lip of a bucket or the like. The adaptor may in some instance comprise an adaptor body and an adaptor nose welded to the lip. The adaptor body has a socket-like recess at its rear end to receivably locate a spigot portion of the adaptor nose. The digging tooth is mounted to the front end of the adaptor body.

In use, excavator teeth and adaptors are subjected to extensive load forces along a longitudinal axis as well as in vertical and transverse directions. A snug fit is required between the digging point and the front portion of the adaptor and also between the adaptor socket and the nose spigot portion and their respective mounting pins to avoid premature wear between the components. As the various components wear, the locking pins can loosen thereby increasing the risk of loss of a digging point or an entire adaptor/tooth combination. This necessitates considerable downtime to replace the lost wear members and where items such as locking pins are not recovered, these can cause damage and/or further downtime in downstream operations such as ore crushing and the like.

The greatest loads experienced by excavator tooth assemblies are vertical loads which tend to generate large moment forces capable of rotating a tooth off the front of an adaptor and/or rotating the adaptor off the adaptor nose. In addition, sideways and twisting loads are frequently imposed on such tooth assemblies.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

OBJECT OF THE INVENTION

It is an object of the invention to overcome or at least alleviate one or more of the above problems and/or provide the consumer with a useful or commercial choice.

Other preferred objects of the present invention will become apparent from the following description.

SUMMARY OF THE INVENTION

In one form, although it need not be the only or indeed the broadest form, the invention resides in an excavator wear assembly comprising:

a mounting nose having a rear bearing face, a forward bearing face, an upper bearing face disposed at an angle between the rear bearing face and the forward bearing face, a front face substantially perpendicular to the forward bearing face and a rib extending over at least part of the upper bearing face, forward bearing face and front face; and a wear member having a rearwardly opening socket adapted to receive the mounting nose, the socket being at least partially defined by a top wall and a front wall, the wear member having a recess formed in the top wall and front wall adapted to receive at least part of the rib.

Preferably the rear bearing face is substantially parallel to the forward bearing face.

Preferably the mounting nose comprises side surfaces. Typically, the side surfaces will be substantially parallel relative to each other. Preferably the side surfaces have a fitment face and a forward fitment face forward of the fitment face. Preferably the forward fitment face will extend at a different orientation to the fitment face.

Preferably an aperture extends between the side surfaces. Preferably the aperture is adapted to accept at least part of a lock assembly. Preferably the aperture is shaped to prevent rotation of the lock assembly.

Preferably the mounting nose comprises a bottom surface. Preferably the bottom surface comprises a bottom rear bearing face. Preferably the rear bearing face and the bottom rear bearing face are parallel relative to one another. Preferably the bottom surface comprises a lower bearing face. Preferably the upper bearing face and the lower bearing face converge in a forward direction. Preferably the bottom surface comprises a bottom forward bearing face. Preferably the bottom forward bearing face and the forward bearing face are parallel relative to one another. Preferably the bottom forward bearing face is substantially perpendicular to the front face.

Preferably the rib extends over at least part of the bottom surface. More preferably, the rib extends over at least part of the lower bearing face and the bottom forward bearing face.

Preferably a top surface of the rib contours at least part of the upper bearing face, the forward bearing face and the front face. Preferably the rib is centrally located on the mounting nose. Preferably the rib has a substantially flat top surface (i.e. the surface furthest away from the bearing faces of the mounting nose). Preferably the rib has rib side walls that converge towards the top surface of the rib. More preferably, the rib side walls converge towards the top surface of the rib in an arcuate manner.

Preferably the mounting nose is integrally formed with a lip of an excavator.

The wear member is preferably an adaptor. Alternatively, the wear member may be an excavator tooth.

Preferably the rearwardly opening socket of the wear member is complementarily shaped to the mounting nose as described in this specification.

Preferably, the top wall has a rear abutment face. Preferably, the top wall has an upper abutment face. Preferably the top wall has a forward abutment face. Preferably the rear abutment face and the forward abutment face are substantially parallel relative to one another. Preferably the upper abutment face is disposed at an angle between the rear abutment face and the forward abutment face.

Preferably the socket is further defined by side walls. Preferably each side wall will have a fitment surface and a forward fitment surface. Preferably the fitment surface and the forward fitment surface are offset relative to each other. Preferably the fitment surface extends at a different orientation to the forward fitment surface. Preferably each side wall comprises an aperture. Preferably the apertures are aligned transverse apertures. Preferably the apertures are adapted to accept at least part of a lock assembly.

Preferably the front wall is substantially perpendicular to the forward abutment face. Preferably the front wall is substantially perpendicular to each of the sidewalls.

Preferably the rearwardly opening socket is further at least partially defined by a bottom wall. Preferably, the bottom wall has a bottom rear abutment face. Preferably, the bottom wall has a lower abutment face. Preferably the bottom wall has a bottom forward abutment face. Preferably the bottom rear abutment face and the bottom forward abutment face are substantially parallel relative to one another. Preferably the upper abutment face and the lower abutment face converge in a forward direction.

Preferably the recess is formed in the upper abutment face and the forward abutment face. Preferably the recess is formed in the lower abutment face and the bottom forward abutment face. More preferably the recess is formed in the upper abutment face, the forward abutment face, the front wall, the lower abutment face and the bottom forward abutment face. Preferably, the recess is centrally located (i.e. relative to the side walls). Preferably the recess has a substantially flat bottom surface. Preferably the recess has recess side walls that converge towards the bottom surface. More preferably the recess side walls converge towards the bottom surface in an arcuate manner.

Preferably the excavator wear assembly comprises a lock assembly. Preferably the lock assembly is adapted to releasably secure the wear member to the mounting nose. Preferably the lock assembly is a retaining pin assembly.

In another form, the invention resides in a wear member, the wear member comprising:

a rearwardly opening socket at least partially defined by a top wall and a front wall; and a recess formed in at least part of the top wall and front wall.

Preferably the wear member is a wear member as described in this specification.

In a further form, the invention resides in a mounting nose having:

a rear bearing face;

a forward bearing face;

an upper bearing face disposed at an angle between the rear bearing face and the forward bearing face;

a front face substantially perpendicular to the forward bearing face; and a rib extending over at least part of the upper bearing face, forward bearing face and front face.

Preferably the mounting nose is a mounting nose as described in this specification.

In yet another form, the invention resides in a method of mounting a wear member on a mounting nose, the method including the steps of:

aligning a recess formed within a rearwardly opening socket of the wear member with a rib extending over at least part of an upper bearing face, a forward bearing face and a front bearing face of the mounting nose;

inserting the mounting nose into the rearwardly opening socket of the wear member such that the recess receives at least part of the rib; and securing the wear member to the mounting nose.

Preferably the step of securing the wear member to the mounting nose includes using a lock assembly to releasably secure the wear member to the mounting nose.

BRIEF DESCRIPTION OF THE DRAWINGS

To assist in understanding the invention and to enable a person skilled in the art to put the invention into practical effect, preferred embodiments of the invention will be described by way of example only with reference to the accompanying drawings, wherein.

DETAILED DESCRIPTION OF THE DRAWINGS

Figure 1:
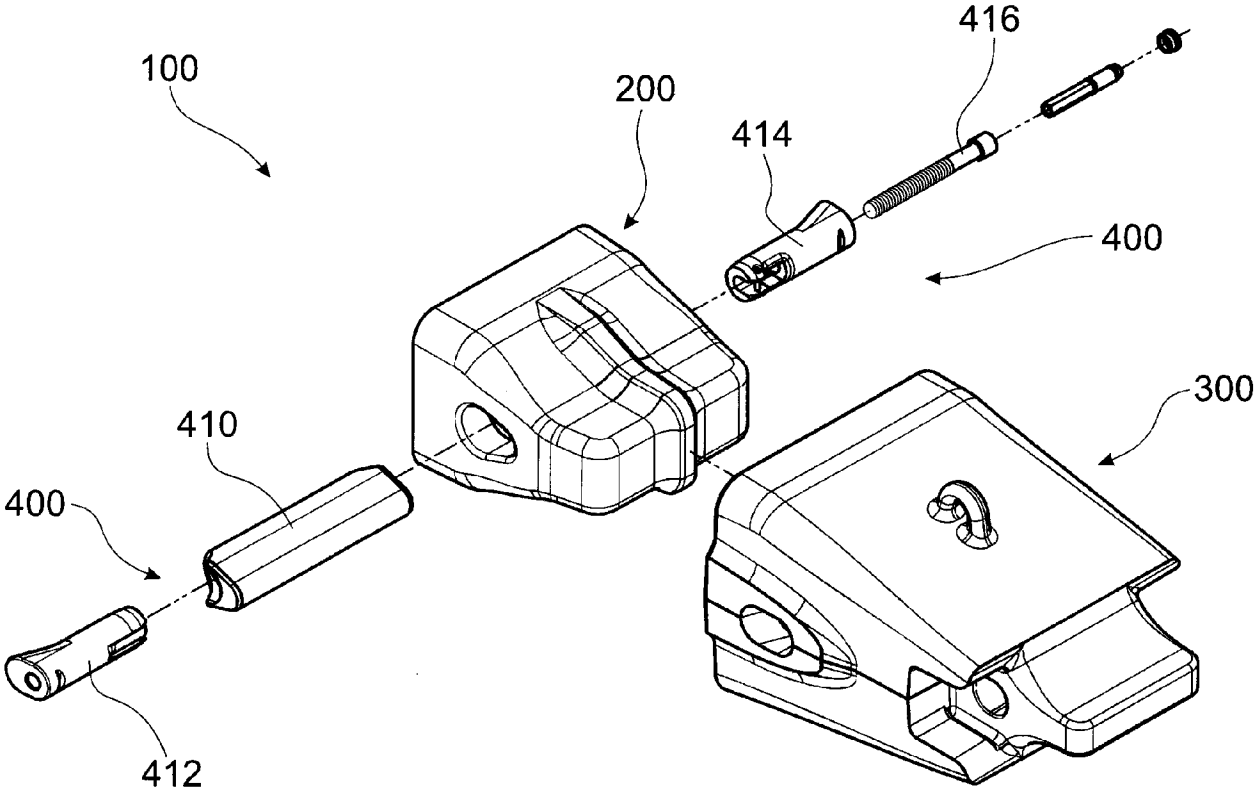
FIG. 1 shows an exploded perspective view of an excavator wear assembly according to an embodiment of the invention.

FIG. 1 shows an exploded perspective view of an excavator wear assembly 100. The excavator wear assembly 100 comprises a mounting nose 200, a wear member in the form of an adaptor 300, adapted to receive at least part of the mounting nose 200, and a lock assembly in the form of a retaining pin assembly 400, adapted to secure the adaptor 300 to the mounting nose 200.

The retaining pin assembly has a retainer body 410, tapered pins 412,414 and a threaded screw 416.

Figure 2:
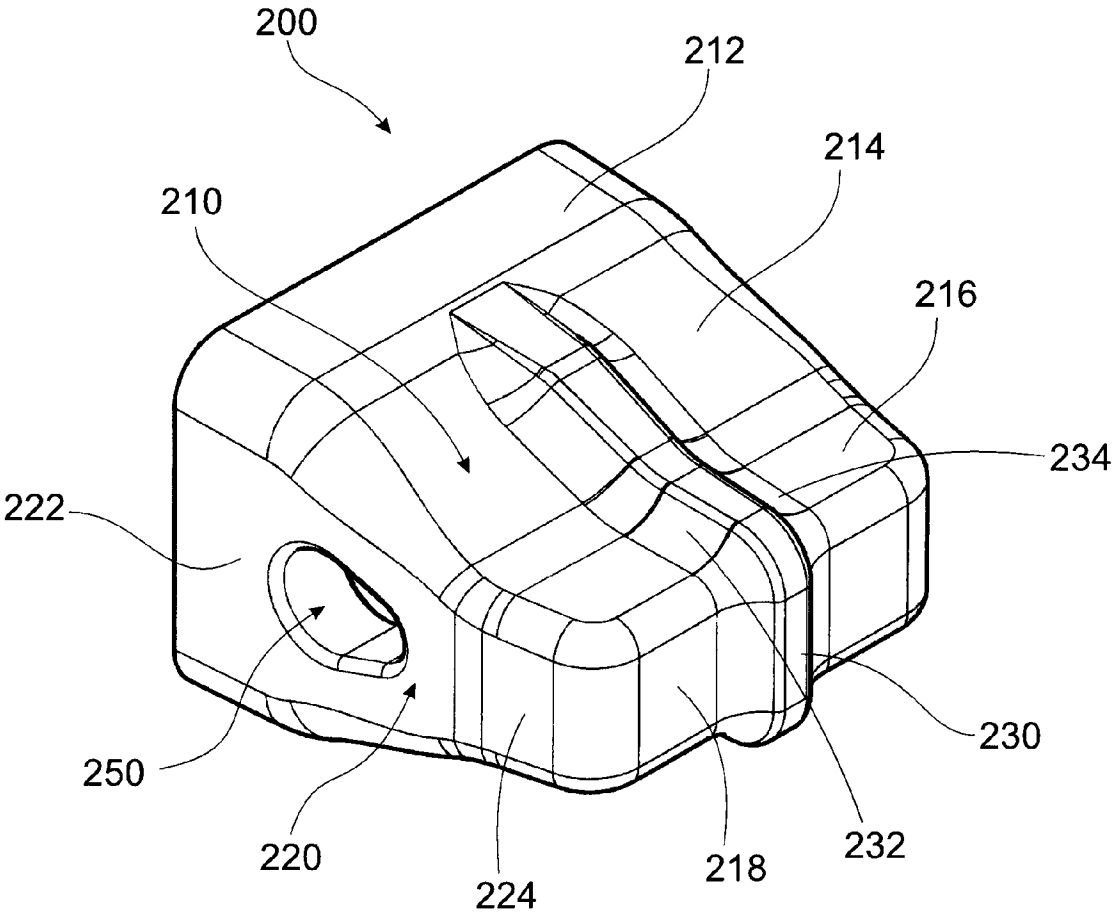
FIG. 2 shows a perspective view of a nose according to an embodiment of the invention.

With reference to FIG. 2, there is shown a mounting nose 200. The mounting nose 200 has a top surface 210, a bottom surface (not shown, similar in configuration to the top surface 210), side walls 220 (only one shown) and a front face 218.

The top surface 210 has a rear bearing surface 212, an upper bearing surface 214 and a forward bearing surface 216.

The side walls 220 have a fitment face 222 and a forward fitment face 224. An aperture 250 extends between the side walls 220. The aperture 250 is adapted to receive part of a retaining pin assembly (eg 400 as seen in FIG. 1).

A rib 230 extends over part of the upper bearing face 214, the forward bearing face 216 and the front face 230. The rib 230 also extends in a similar manner over the bottom surface (not shown).

The rib 230 has rib side walls 232,234. The rib side walls 232,234 converge towards a top surface of the rib 230 in an arcuate manner.

Figure 3:
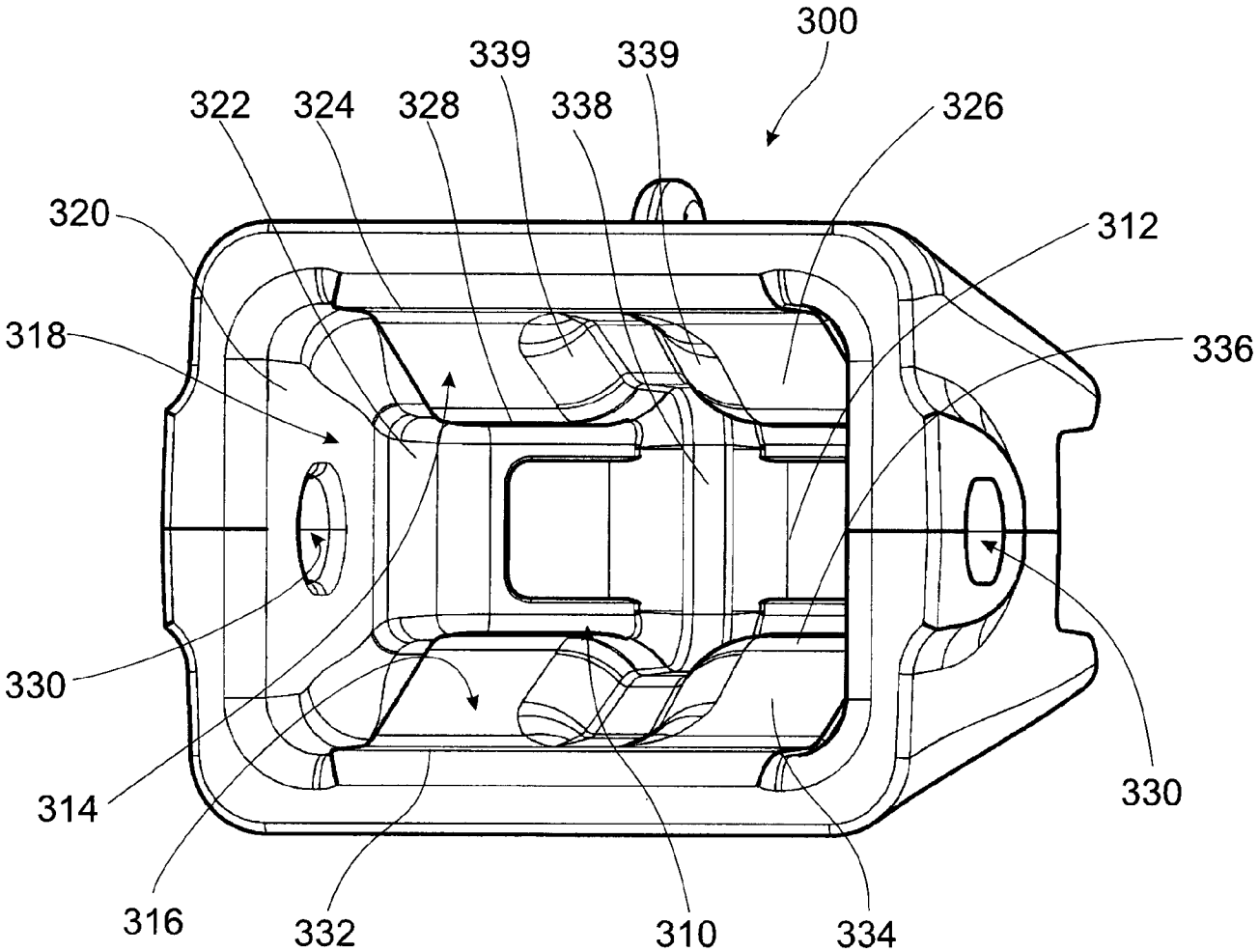
FIG. 3 shows a rear view of a wear member according to an embodiment of the invention.
Figure 4:
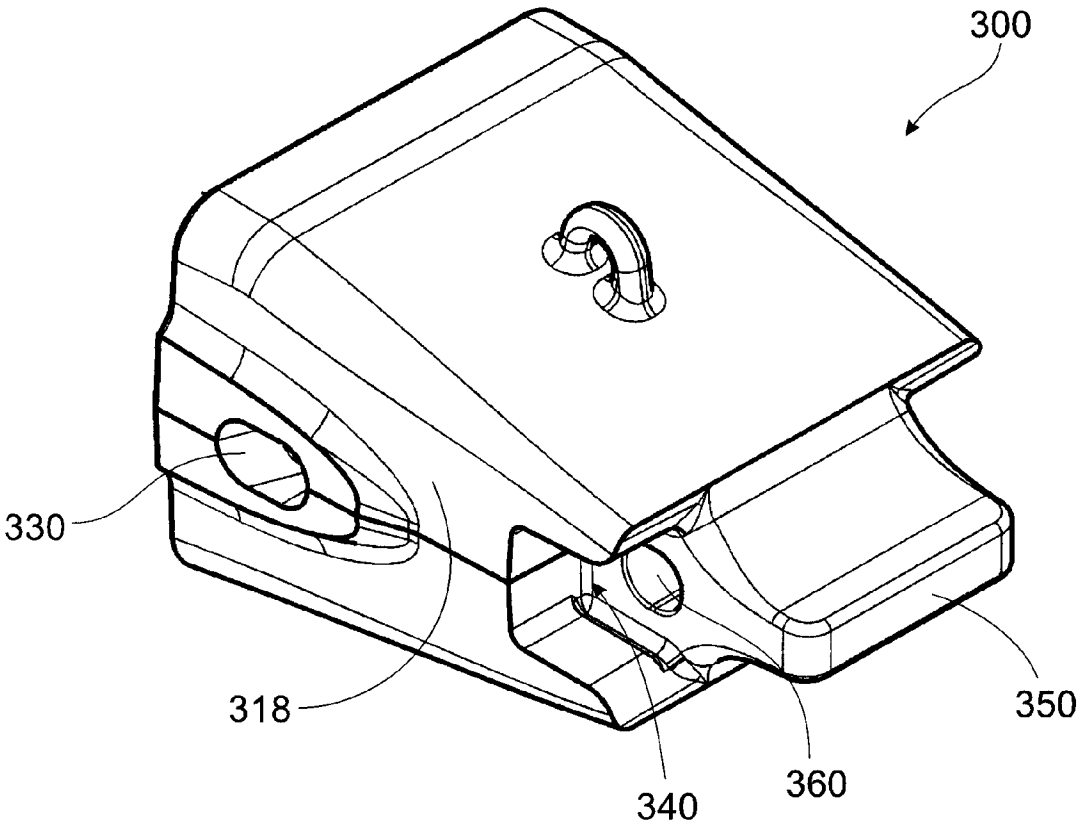
FIG. 4 shows a perspective view of the wear member of FIG. 3.

With reference to FIGS. 3 and 4, there is shown a wear member in the form of an adaptor 300. The adaptor 300 has a socket 310 opening in a rear end thereof. The socket 310 is shaped to accept at least part of a mounting nose (eg 200 as seen in FIG. 2). The socket 310 is partially defined by a front wall 312, top wall 314, a bottom wall 316 and side walls 318.

Top wall 314 has a rear abutment face 324, an upper abutment face 326 and a abutment bearing face 328. The abutment faces 324,326,328 are adapted to abut corresponding bearing faces on a mounting nose (for example 212,214, 216 in FIG. 2).

The bottom wall 316 has a rear abutment face 332, a lower abutment face 334 and a forward abutment face 336. The abutment faces 332,334,336 are adapted to abut corresponding bearing faces on a mounting nose (not shown).

The side walls 318 have a fitment surface 320 and a forward fitment surface 322. The fitment surfaces 320,322 are adapted to abut corresponding fitment faces on a mounting nose (for example 222,224 in FIG. 2).

The top wall 314, bottom wall 316 and front wall 312 contain a recess 338. The recess 338 is shaped to accept at least part of a rib (eg 230 as seen in FIG. 2). The recess 338 has recess side walls 339. The recess side walls 339 converge towards a bottom surface of the recess 338 in an arcuate manner.

Adaptor 300 has aligned transverse apertures 330 each extending through a respective opposed side wall 318. Aligned transverse apertures 330 are adapted to receive part of a retaining pin assembly (eg 400 as seen in FIG. 1) which extends through aligned transverse apertures 330 and an aperture in a mounting nose (eg 250 as seen in FIG. 2) to thereby retain the adaptor 300.

Additionally, adaptor 300 has a pair of side wall mounting recesses 340 located in a forward portion of respective opposed side walls 318. Side wall mounting recesses 340 are shaped to be complementary with mounting ears of a digging tooth (not shown).

Adaptor 300 further includes a spigot portion 350 extending from a forward portion thereof. The spigot portion 350 is shaped to be complementary with a socket cavity of a digging tooth (not shown).

Spigot portion 350 also has a retaining passage 360 extending therethrough to releasably secure a digging tooth (not shown) to the adaptor 300 with a retaining pin (not shown).

In use, with reference to FIGS. 1-4, the retainer body 410 of the retaining pin assembly 400 is inserted into the aperture 250. The mounting nose 200 is aligned with the adaptor 300 such that the centrally located rib 230 on the mounting nose 200 aligns with the recess 338 in the socket 310 of the adaptor 300.

The mounting nose 200 is received into the complementary shaped socket 310 of the adaptor 300. The rib 230 is received into the complementary shaped recesses 338.

The recess 338 of the adaptor 300 and the rib 230 can provide additional horizontal stabilisation of the adaptor 300 relative to the mounting nose 200. The rib 230 also provides additional vertical strengthening of the mounting nose 200.

The aligned transverse apertures 330 of the adaptor 300 align with the aperture 250 in the mounting nose 200. Tapered pins 412,414 are inserted through corresponding aligned transverse apertures 330. Threaded screw 416 connects the tapered pins 412,414. Tightening of the threaded screw 416 forces the tapered pins 412,414 together, due to the taper of the tapered pins 412,414 and a taper in each of the aligned transverse apertures 330, this releasably secures the adaptor 300 to the mounting nose 200.

Throughout the specification the aim has been to describe the invention without limiting the invention to any one embodiment or specific collection of features. Persons skilled in the relevant art may realize variations from the specific embodiments that will nonetheless fall within the scope of the invention. For example, individual features from one embodiment may be combined with another embodiment.

It will be appreciated that various other changes and modifications may be made to the embodiment described without departing from the spirit and scope of the invention. For example, a digging tooth may be mounted to the mounting nose instead of an adaptor.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The invention claimed is:

1. An excavator wear assembly comprising:

a mounting nose having a rear bearing face, a forward bearing face, an upper bearing face disposed at a different angle to the rear bearing face or the forward bearing face, a front face substantially perpendicular to the forward bearing face and a rib extending over at least part of the upper bearing face, forward bearing face and front face; and a wear member having a rearwardly opening socket adapted to receive the mounting nose, the socket being at least partially defined by a top wall and a front wall, the wear member having a recess formed in the top wall and front wall adapted to receive at least part of the rib.

2. An excavator wear assembly as claimed in claim 1, wherein the rear bearing face is substantially parallel to the forward bearing face.

3. An excavator wear assembly as claimed in claim 1, wherein the mounting nose comprises side surfaces, the side surfaces each having a fitment face and a forward fitment face forward of the fitment face, the forward fitment face extending at a different orientation to the fitment face.

4. An excavator wear assembly as claimed in claim 1, wherein the mounting nose comprises a bottom surface having a bottom rear bearing face, a lower bearing face and a bottom forward bearing face, wherein the upper bearing face and the lower bearing face converge in a forward direction.

5. An excavator wear assembly as claimed in claim 4, wherein the rib extends over at least part of the lower bearing face and the bottom forward bearing face.

6. An excavator wear assembly as claimed in claim 1, wherein the rib has a substantially flat top surface and side walls of the rib converge towards the substantially flat top surface of the rib.

7. An excavator wear assembly as claimed in claim 1, further comprising a lock assembly adapted to releasably secure the wear member to the mounting nose.

8. A wear member comprising:

a rearwardly opening socket at least partially defined by a top wall and a front wall; and a recess formed in at least part of the top wall and front wall, wherein the top wall has a rear abutment face, a forward abutment face and an upper abutment face, the upper abutment face disposed at a different angle to the rear abutment face or the forward abutment face.

9. A wear member as claimed in claim 8, wherein the socket is further defined by a bottom wall having a bottom rear abutment face, a bottom forward abutment face and an lower abutment face, the lower abutment face disposed at an angle between the bottom rear abutment face and the bottom forward abutment face.

10. A wear member as claimed in claim 9, wherein the recess is formed in the upper abutment face, the forward abutment face, the front wall, the lower abutment face and the bottom forward abutment face.

11. A wear member as claimed in claim 8, wherein the socket is further defined by side walls, each side wall having a fitment surface and a forward fitment surface, wherein the fitment surface and the forward fitment surface are offset relative to each other.

12. A wear member as claimed in claim 11, wherein the recess is centrally located relative to the side walls.

13. A wear member as claimed in claim 8, wherein the recess has a substantially flat bottom surface and recess side walls that converge towards the bottom surface.

14. A mounting nose having:

a rear bearing face;

a forward bearing face;

an upper bearing face disposed at a different angle to the rear bearing face or the forward bearing face;

a front face substantially perpendicular to the forward bearing face; and a rib extending over at least part of the upper bearing face, forward bearing face and front face.

15. A mounting nose as claimed in claim 14, wherein the rear bearing face is substantially parallel to the forward bearing face.

16. A mounting nose as claimed in claim 14, further comprising side surfaces, the side surfaces each having a fitment face and a forward fitment face forward of the fitment face, the forward fitment face extending at a different orientation to the fitment face.

17. A mounting nose as claimed in claim 14, further comprising:

a bottom surface having:

a bottom rear bearing face;

a lower bearing face; and a bottom forward bearing face, wherein the upper bearing face and the lower bearing face converge in a forward direction.

18. A mounting nose as claimed in claim 17, wherein the rib extends over at least part of the lower bearing face and the bottom forward bearing face.

19. A mounting nose as claimed in claim 14, wherein the rib has a substantially flat top surface and side walls of the rib converge towards the substantially flat top surface of the rib.

20. A mounting nose as claimed in claim 14, wherein the mounting nose is integrally formed with a lip of an excavator.

21. A method of mounting a wear member on a mounting nose, the method including the steps of:

aligning a recess formed within a rearwardly opening socket of the wear member with a rib extending over at least part of an upper bearing face, a forward bearing face and a front bearing face of the mounting nose, the upper bearing face disposed at a different angle to the forward bearing face or a rear bearing face of the mounting nose;

inserting the mounting nose into the rearwardly opening socket of the wear member such that the recess receives at least part of the rib; and securing the wear member to the mounting nose.

22. A method as claimed in claim 21, wherein the step of securing the wear member to the mounting nose includes using a lock assembly to releasably secure the wear member to the mounting nose.

23. An excavator wear assembly comprising:

a mounting nose having a rear bearing face, a forward bearing face, an upper bearing face disposed at an angle to the rear bearing face or the forward bearing face, a front face substantially perpendicular to the forward bearing face and a rib extending over at least part of the upper bearing face, forward bearing face and front face; and a wear member having a rearwardly opening socket adapted to receive the mounting nose, the socket being at least partially defined by a top wall and a front wall, the wear member having a recess formed in the top wall and front wall adapted to receive at least part of the rib, wherein the front face of the mounting nose is adapted to bear on the front wall of the wear member as the wear member is first fitted to the mounting nose.

24. A wear member comprising:

a rearwardly opening socket at least partially defined by a top wall, side walls and a front wall; and a recess formed in at least part of the top wall and front wall, wherein one side wall includes an aperture for receiving a lock therethrough.

25. A wear member as claimed in claim 24, wherein another sidewall includes an aperture for receiving the lock therethrough.

* * * * *